US007631983B2

(12) United States Patent
Chu et al.

(10) Patent No.: US 7,631,983 B2
(45) Date of Patent: Dec. 15, 2009

(54) ALL-IN-ONE ADAPTER CONTAINER

(75) Inventors: Chun-Hung Chu, Taipei County (TW); Wei-Chueh Liao, Taipei (TW); Hui-Yun Hsu, Taipei County (TW); Chia-Hsiang Chiu, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 264 days.

(21) Appl. No.: 11/437,355

(22) Filed: May 19, 2006

(65) Prior Publication Data

US 2007/0091592 A1 Apr. 26, 2007

(30) Foreign Application Priority Data

Oct. 26, 2005 (TW) ..... 94137443 A

(51) Int. Cl.
*F21V 33/00* (2006.01)

(52) U.S. Cl. ..... 362/154; 362/258; 362/800

(58) Field of Classification Search ..... 362/154, 362/375, 258, 387; 242/167, 174, 176–178; 206/391, 397, 404, 405, 408, 495, 702; 862/154, 862/375; 320/113, 115

See application file for complete search history.

(56) References Cited

U.S. PATENT DOCUMENTS

| | | | | |
|---|---|---|---|---|
| 5,738,548 | A * | 4/1998 | Rutulante | 439/652 |
| 5,773,757 | A * | 6/1998 | Kenney et al. | 174/53 |
| 6,254,251 | B1 * | 7/2001 | Washington | 362/154 |
| 6,428,181 | B1 * | 8/2002 | Moriarty | 362/154 |
| 6,589,069 | B1 * | 7/2003 | Liao | 439/501 |
| 6,715,902 | B1 * | 4/2004 | Herring | 362/295 |
| 6,765,365 | B2 * | 7/2004 | Kim et al. | 320/112 |
| 6,774,603 | B2 * | 8/2004 | Liao | 320/107 |
| 6,848,802 | B2 * | 2/2005 | Chen | 362/85 |
| 7,017,055 | B1 * | 3/2006 | Ho | 713/300 |
| 2003/0141840 | A1 * | 7/2003 | Sanders | 320/107 |

FOREIGN PATENT DOCUMENTS

CN 2676453 Y 2/2005

* cited by examiner

*Primary Examiner*—Jong-Suk (James) Lee
*Assistant Examiner*—Leah S Lovell
(74) *Attorney, Agent, or Firm*—Quintero Law Office

(57) ABSTRACT

An all-in-one adapter container. The all-in-one adapter container comprises a space, a cover covering the space, at least one power line, a printed circuit board (PCB) and at least one line-arranging mechanism. The line-arranging mechanism provides arrangement for the power line. The printed circuit board is electrically connected to the power line.

8 Claims, 4 Drawing Sheets

ALL-IN-ONE ADAPTER CONTAINER

BACKGROUND OF THE INVENTION

1. Field of the Invention

The invention relates to all-in-one adapter container, and in particular relates to a container for arrangement of adapters.

2. Description of the Related Art

An adapter, used as a transformer or a power connector, transmits electricity to an electronic device. Many kinds of electronic devices are produced. The standard of every kind of electronic device is different, thus, electronic devices use different standard adapters to transmit electricity. Regardless of where an electronic device is used many kinds of adapters must be gathered, thereby increasing inconvenience of arrangement.

BRIEF SUMMARY OF INVENTION

A detailed description is given in the following embodiments with reference to the accompanying drawings. The invention provides an all-in-one adapter container. The all-in-one adapter container comprises a space, a cover covering the space, at least a power line, a printed circuit board and at least an line-arranging mechanism for arranging the power line. The container provides for arranging kinds of adapters (plugs and tips) via the space and further comprises a line-arranging mechanism to arrange the power line (DC-OUT cable and DC-IN cable).

The container is portable and convenient means of arranging adapters and power lines.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
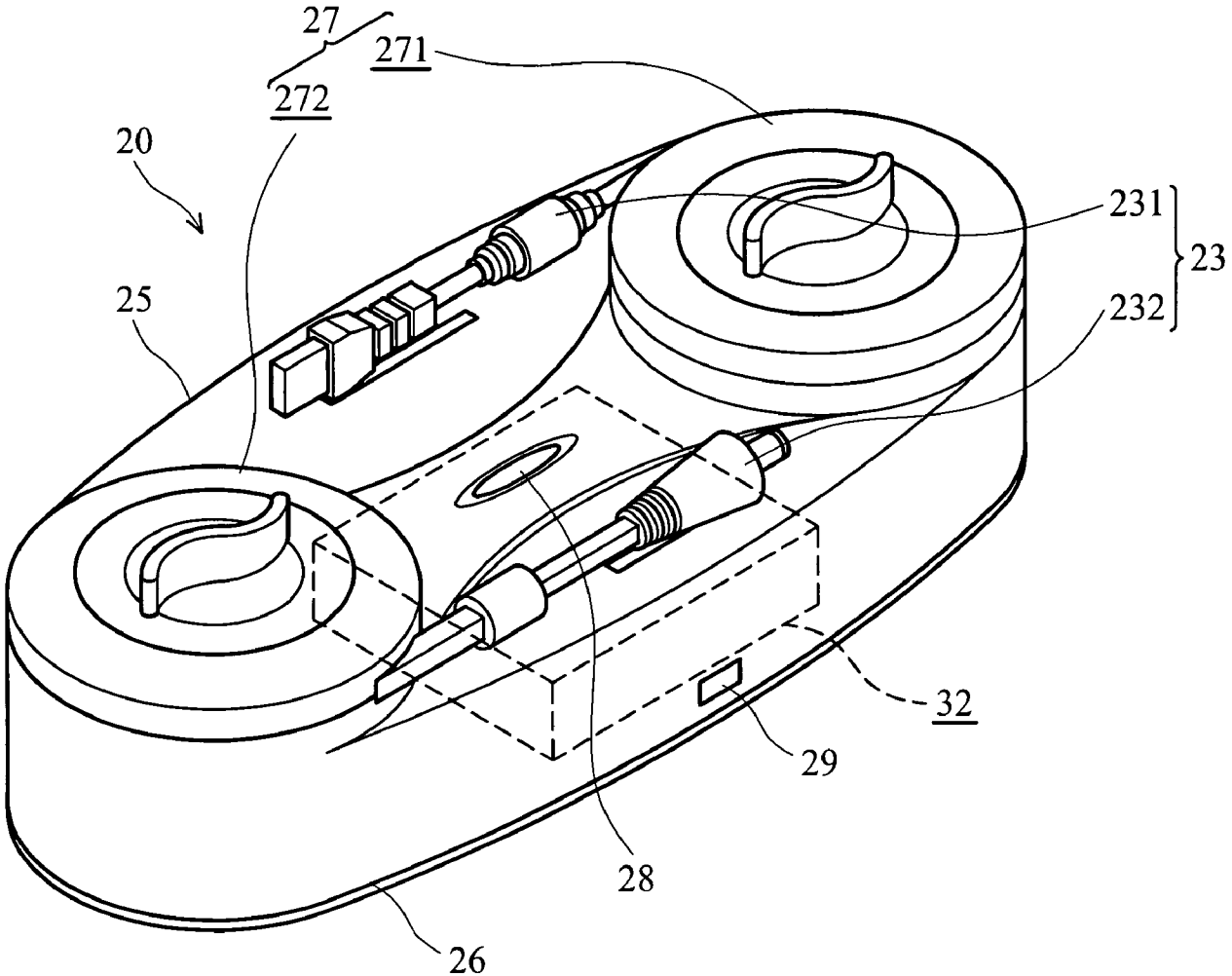
FIG. 1 is a schematic view showing the container of the invention.
Figure 2:
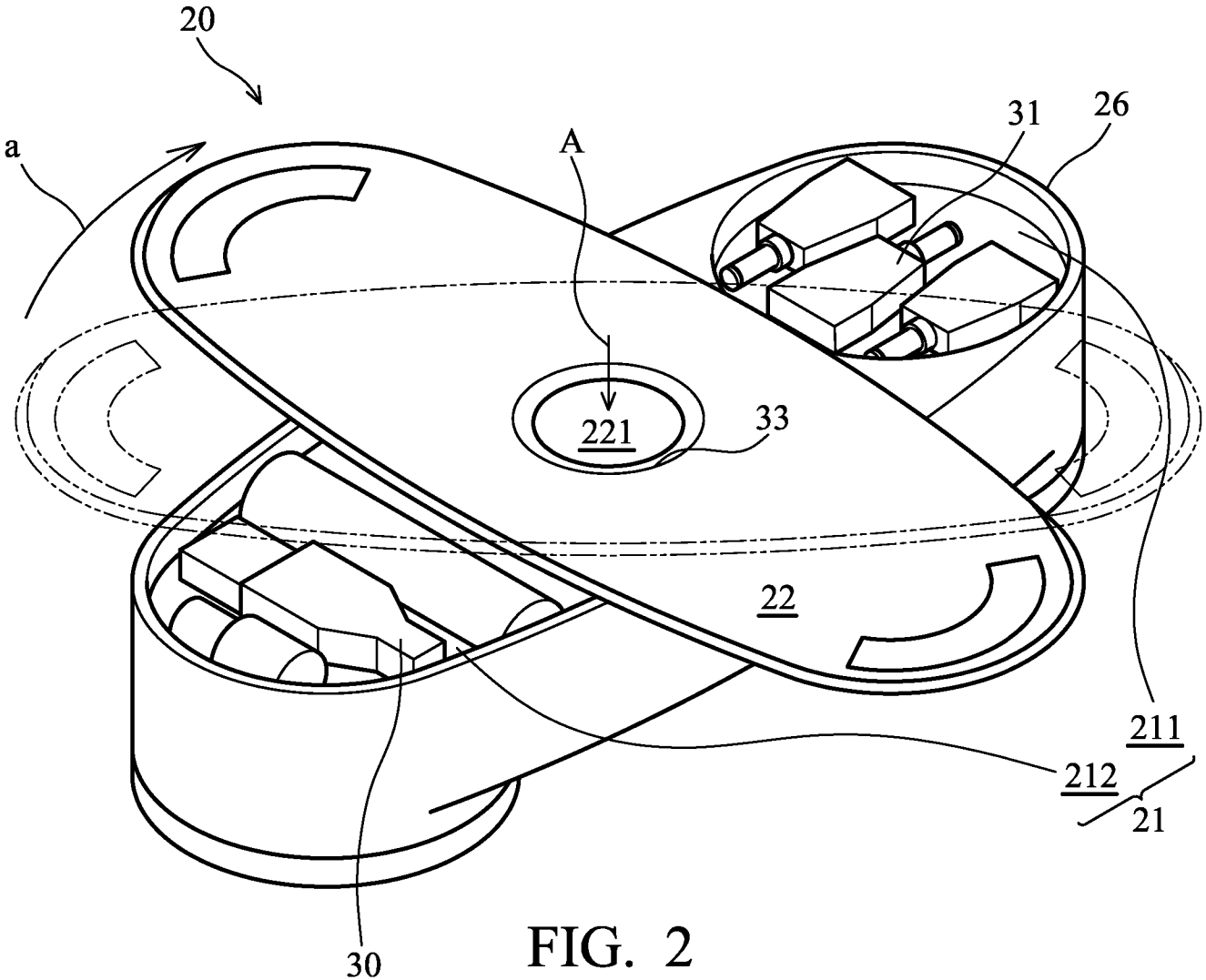
FIG. 2 is a schematic view showing the container open.

Referring to FIGS. 1 and 2, an adapter container 20 comprises a space 21, a cover 22 to cover the space 21, at least a power line 23, a printed circuit board 32 and at least a line-arranging mechanism 27. The line-arranging mechanism 27 is installed on the adapter container 20 to be wound by power line 23 for arranging the power line 23. In this embodiment, the container 20 has a top surface 25(shown by FIG. 2) and a bottom surface 26. The power lines 23 comprise a first power line 231 and a second power line 232 installed on the top surface 25. The first power line 231 is a DC-OUT cable and the second power line 232 is a DC-IN cable. The line-arranging mechanisms 27 comprise a first line-arranging mechanism 271 for arranging the first power line 231 and a second line-arranging mechanism 272 for arranging the second power line 232. The printed circuit board 32 is electrically connected to the first power line 231, the second power line 232 and a universal serial bus 29. In this embodiment, the universal serial bus 29 is installed on a side of the container 20 for transmitting electricity to an electronic device having a universal serial bus plug. Moreover, a luminous element 28 is installed on the top surface 25. When the container 20 conducts electricity, the luminous element 28 is illuminated. In this embodiment, the luminous element 28 is a light emitting diode.

Figure 3:
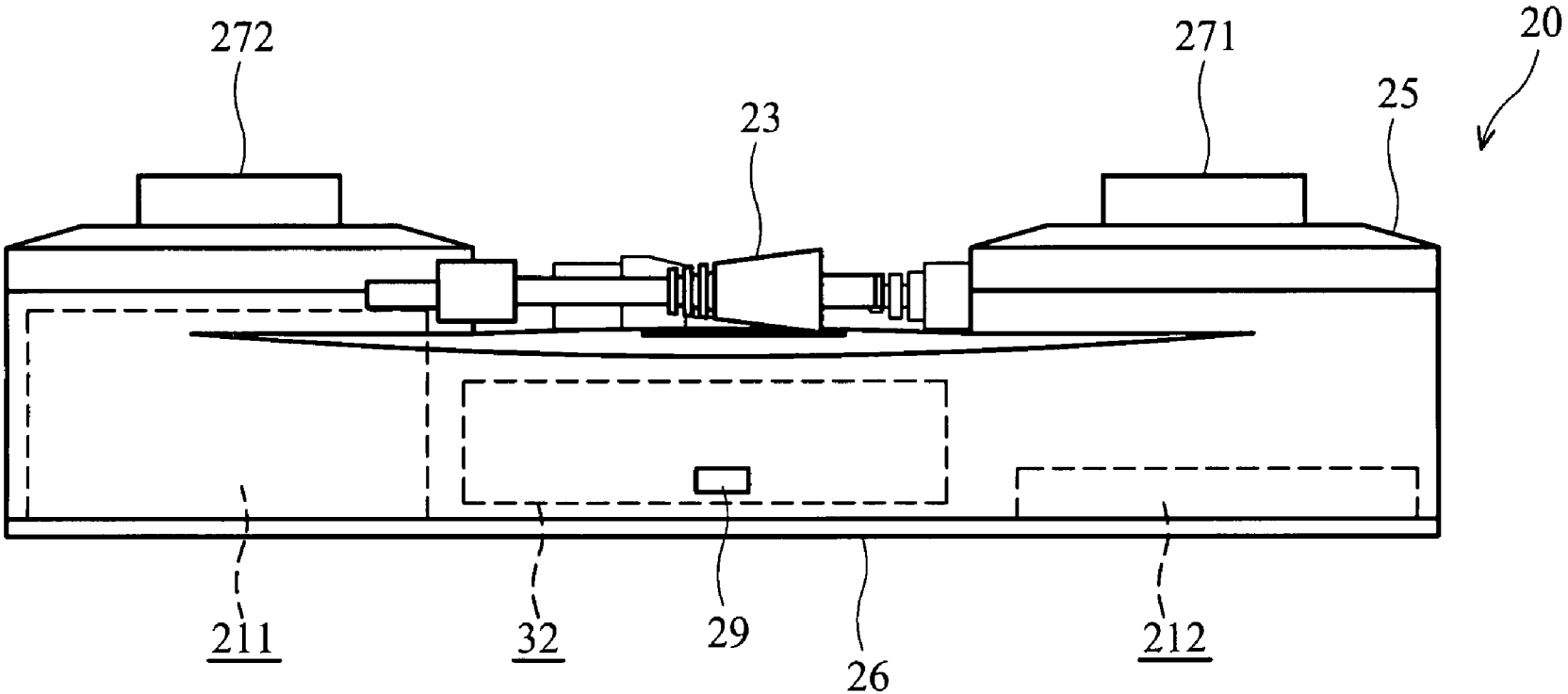
FIG. 3 is a lateral view of the container of the invention.

Referring to FIGS. 2 and 3, the spaces 21 comprise a first subspace 211 and a second subspace 212 on two sides of the container 20. The cover 22 pivots on a pivoted element 33 of the container 20 to cover the space 21. A button is installed on the cover 22 for opening or closing the cover 22. In this embodiment, the second subspace 212 contains plugs 30, for example a car DC plug, AC plug or an airplane DC plug. The first subspace 211 contains different tips 31.

Figure 4:
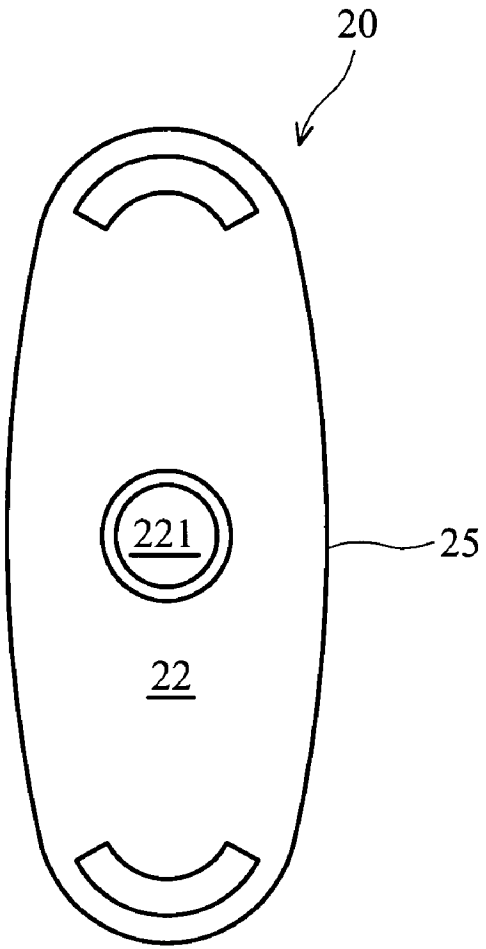
FIG. 4 is a schematic view s showing the container closed.

Referring to FIGS. 3 and 4, FIG. 4 shows the top surface 25 closed. When the container 20 is not used, the cover 22 is closed. If a user uses the adapter (a plug 30 or a tip 31) in the container 20 to transmit electricity to an electronic device, the second power line 232 (DC-IN cable) is connected thereto, and then the cover 22 is rotated (along arrow a) to open via the button 221 for taking the adapter (plug 30 or tip 31) out, then the adapter (plug 30 or tip 31) is electrically connected to the first power line 231 (DC-OUT cable), then the adapter (plug 30 or tip 31) is electrically connected to the power source (not shown). Because the printed circuit board 32 is electrically connected to the first power line 231 and the second power line 232, the electricity from the power source is transmitted to an electronic device via the first power line 231 and the second power line 232.

If a user uses an electronic device having a universal serial bus plug, the universal serial bus plug is electrically connected to the universal serial bus 29, and then the adapter (plug 30 or tip 31) is electrically connected to the first power line 231 (DC-OUT cable), and then the adapter (plug 30 or tip 31) is electrically connected to the power source(not shown). Because the printed circuit board 32 is electrically connected to the universal serial bus 29, the electricity from the power source is transmitted to an electronic device via the first power line 231 and the universal serial bus 29.

The invention provides an all-in-one adapter container 20 for arranging different kinds of the adapters. The invention further comprises a line-arranging mechanism 27 for arranging the power line, thus, the all-in-one adapter container is portable and convenient means of arranging adapters and power lines.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An all-in-one adapter container, comprising:

a space;

a rotatable cover, covering the space;

at least a first power line;

at least a first line-arranging mechanism to be wound by the first power line for arrangement the first power;

a printed circuit board electrically connecting to the first power line;

a pivoted element, pivoting the rotatable cover on the container; and a universal serial bus installed on a side of the container and electrically connected to the printed circuit board.

2. The all-in-one adapter container as claimed in claim 1, wherein the space comprises a first subspace and a second subspace located on sides of the container.

3. The all-in-one adapter container as claimed in claim 1, further comprising a button on the rotatable cover for opening or closing the rotatable cover.

4. The all-in-one adapter container as claimed in claim 1 further comprising a second power line and a second line-arranging mechanism for arranging the second power line.

5. The all-in-one adapter container as claimed in claim 4, wherein the second power line comprises a DC-OUT cable to be collected in the second line-arranging mechanisms.

6. The all-in-one adapter container as claimed in claim 1, further comprising a luminous element on the container, wherein when the container conducts electricity, the luminous element shines.

7. The all-in-one adapter container as claimed in claim 6, wherein the luminous element comprises a light emitting diode.

8. The all-in-one adapter container as claimed in claim 1, wherein the first power line comprises a DC-IN cable to be collected in the first line-arranging mechanisms.

* * * * *